US005481291A

United States Patent [19]

Ishida et al.

[11] Patent Number: 5,481,291

[45] Date of Patent: Jan. 2, 1996

[54] RECORDING APPARATUS WITH IMPROVED INK SHEET CONVEYANCE

[75] Inventors: Yasushi Ishida, Tokyo; Minoru Yokoyama, Kanagawa; Akihiro Tomoda, Kanagawa; Masakatsu Yamada, Kanagawa; Takashi Awai, Kanagawa; Takehiro Yoshida; Makoto Kobayashi, both of Tokyo; Satoshi Wada, Kanagawa; Takeshi Ono, Kanagawa; Tomoyuki Takeda, Kanagawa, all of Japan

[73] Assignee: Canon Kabushiki Kaisha, Tokyo, Japan

[21] Appl. No.: 438,067

[22] Filed: May 8, 1995

Related U.S. Application Data

[63] Continuation of Ser. No. 157,435, Nov. 26, 1993, abandoned, which is a continuation of Ser. No. 923,471, Aug. 3, 1992, which is a division of Ser. No. 554,907, Jul. 20, 1990.

[30] Foreign Application Priority Data

Jul. 20, 1989 [JP] Japan ..... 1-186109
Jul. 6, 1990 [JP] Japan ..... 2-177364

[51] Int. Cl.[6] ..... B41J 15/00; B41J 17/00

[52] U.S. Cl. ..... 347/217; 347/218

[58] Field of Search ..... 347/215, 217, 347/218, 219; 346/134, 136

[56] References Cited

U.S. PATENT DOCUMENTS 3,090,299 5/1963 Comstock ..... 101/100
5,122,882 6/1992 Ishida et al. ..... 358/296

FOREIGN PATENT DOCUMENTS 0054664 6/1982 European Pat. Off. .
0189984 8/1986 European Pat. Off. .
0320284 6/1989 European Pat. Off. .
57-83471 5/1982 Japan .
62-58917 1/1983 Japan .
58-201686 11/1983 Japan .
61-116565 6/1986 Japan .

OTHER PUBLICATIONS

European Search Report (Eur. Pat. Appln. No. 89118404.6).

*Primary Examiner*—Huan H. Tran
*Attorney, Agent, or Firm*—Fitzpatrick, Cella, Harper & Scinto

[57] ABSTRACT

In a thermal transfer recording apparatus, an image is recorded on a recording medium by transferring ink of an ink sheet. The ink sheet is wound onto a wind-up roll from a feed roll against an applied load. During the recording process the ink sheet and recording medium are conveyed in opposite directions. After recording of one page is completed, the recording medium is advanced, cut, and then retracted. During advancement of the recording medium to the cutter, the ink sheet is wound onto the wind-up roll at a speed such that the ratio of conveyance speeds of the ink sheet and recording medium is greater than during recording. During retraction of the recording medium, the ink sheet is conveyed by friction with the recording medium in a direction opposed to the load.

16 Claims, 13 Drawing Sheets

RECORDING APPARATUS WITH IMPROVED INK SHEET CONVEYANCE

This application is a continuation of application Ser. No. 08/157,435 filed Nov. 26, 1993, now abandoned, which in turn is a continuation of application Ser. No. 07/923,471 filed Aug. 3, 1992, which is a division of application Ser. No. 07/554,907 filed Jul. 20, 1990.

BACKGROUND OF THE INVENTION

1. Field of the Invention

The present invention relates to an apparatus and a method of thermal transfer recording to record image on a recording medium by transferring ink of the ink sheet on the recording medium.

Here, the thermal transfer recording apparatus includes, facsimile machines, electronic typewriters, copying machines and printers, etc.

2. Related Background Art

Generally speaking, a thermal transfer printer records the image by using an ink sheet obtained by coating heat-meltably (or heat-sublimable, etc.) ink on a base film, heating such ink sheet by the thermal head selectively responding to the image signal and transferring the molten (or sublimated, etc.) ink on to the recording sheet. Since this ink sheet is generally of such type that by one image recording, the ink is completely transferred to the recording sheet (the so-called one-time ink sheet), it was necessary that when recording of one character or one line is over, the ink sheet should be conveyed for the length corresponding to the recorded length so that an unused part of the ink sheet comes to the succeeding recording position with certainty. As the result, the amount of use of the ink sheet increases, and the running cost of thermal transfer printer tends to become high.

In order to solve such problem, they proposed the thermal transfer printer wherein the recording sheet and the ink sheet are conveyed at somewhat different speed as described in Japanese Laid-Open Patent Application No. 57-83471, Japanese Laid-Open Patent Application No. 58-201686 or Japanese Patent Publication No. 62-58917. As described in the references an ink sheet on which image may be recorded plural number of times (the so-called multiprint ink sheet) has been made available and if such ink sheet is used, it is possible to record the image by conveying the ink sheet after completion of recording or during recording of the image for the length smaller than the recording length L (L/n, N>i) at the continuous recording of recording length L. By so doing, the efficiency of use of the ink sheet becomes n times higher than the conventional way of use and thus reduction of running cost of thermal transfer printer can be expected. Hereafter this recording system is called multi-print system.

In the case of the thermal transfer printer which performs such multi-print, moving speed of ink sheet is slower than the moving speed of recording sheet and therefore due to the abrasion between the ink sheet and recording sheet such problem occurs as wrinkling or slackening of the ink sheet. While with this type of printer, it is normal that the equipment is provided with a cutter to cut the recorded sheet in one page length and particularly with the facsimile equipment, it is desirable to have a cutter which cuts the recorded sheet in one page length. However when such cutter is provided, it tends to require conveying of recording sheet in such way that at the completion of recording of one page of recording sheet, the sheet is conveyed in the direction of cutter until the rear edge of the recorded image passes by the position of cutter for the distance inclusive of the margin (the so-called front feed) or after the cutting of the recorded sheet by the cutter, the point near the front edge of the recording sheet is returned to the recording position of thermal head (the so-called back feed).

SUMMARY OF THE INVENTION

An objective of the present invention is to provide a thermal transfer recording apparatus and a method which enable to make a clear record.

Another objective of the present invention is to provide a thermal transfer recording apparatus and the method which enable to convey the ink sheet in preferred state.

Still another objective of the present invention is to provide a thermal transfer recording apparatus and the method which enable to convey the recording medium in preferred state.

Still another objective of the present invention is to provide a thermal transfer and recording apparatus and the method which enable to prevent wrinkling or slackening of ink sheet.

Still another objective of the present invention is to provide, in the light of the conventional examples, the thermal transfer and recording apparatus wherein sagging etc of ink sheet is prevented by conveying ink sheet and the recording sheet in the same direction when recording medium returns in the direction opposite to the recording direction and friction force between ink sheet and recording medium becomes larger than the predetermined level.

DETAILED DESCRIPTION OF THE PREFERRED EMBODIMENT

Now the present invention will be explained in detail by preferred embodiments thereof shown in the attached drawings.

Explanation of Facsimile Equipment (FIGS. 1–4)

Figure 1:
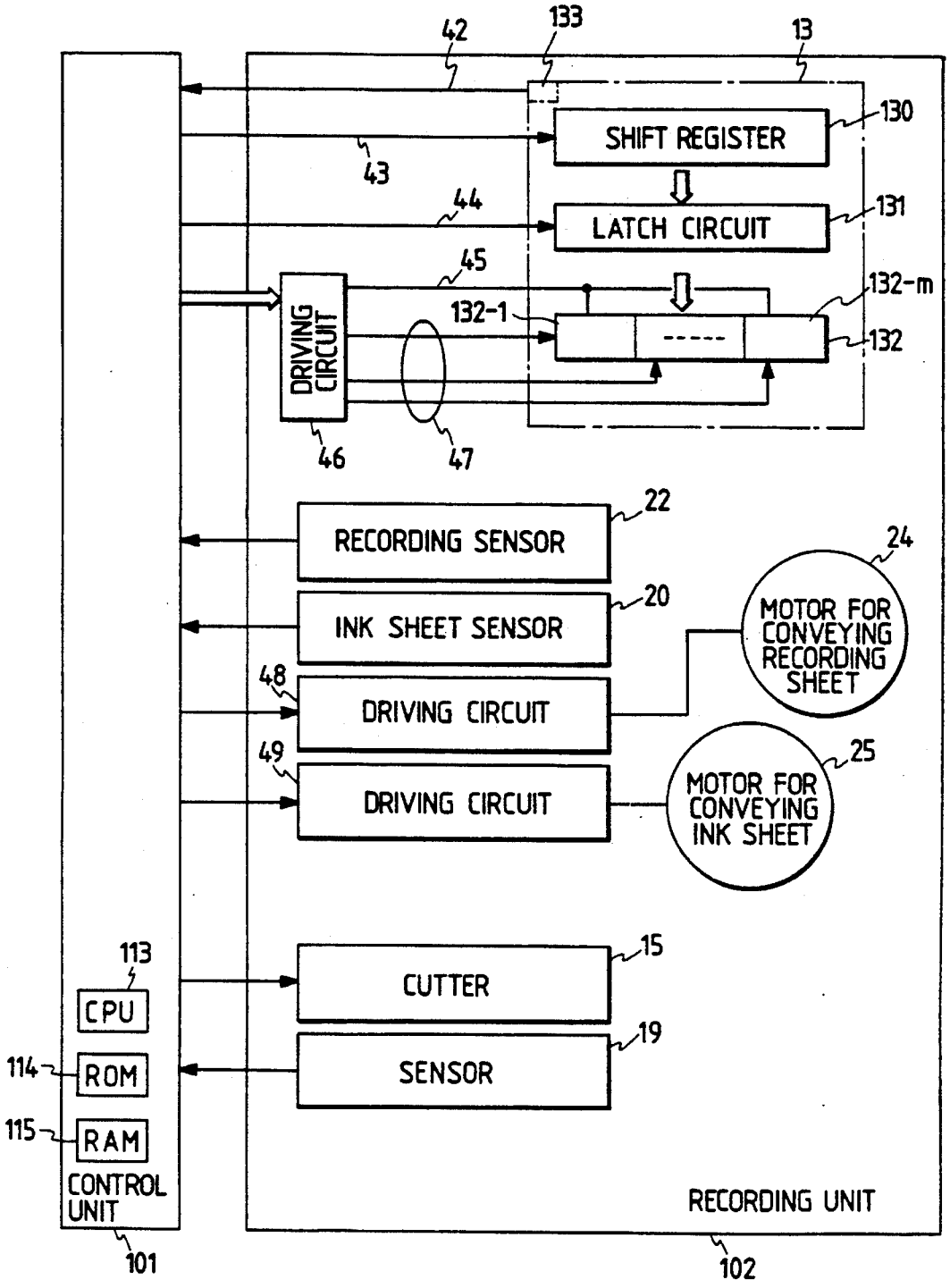
FIG. 1 is a drawing to indicate the electric connection of control unit and recording unit of the facsimile machine which is an embodiment of the present invention.
Figure 2:
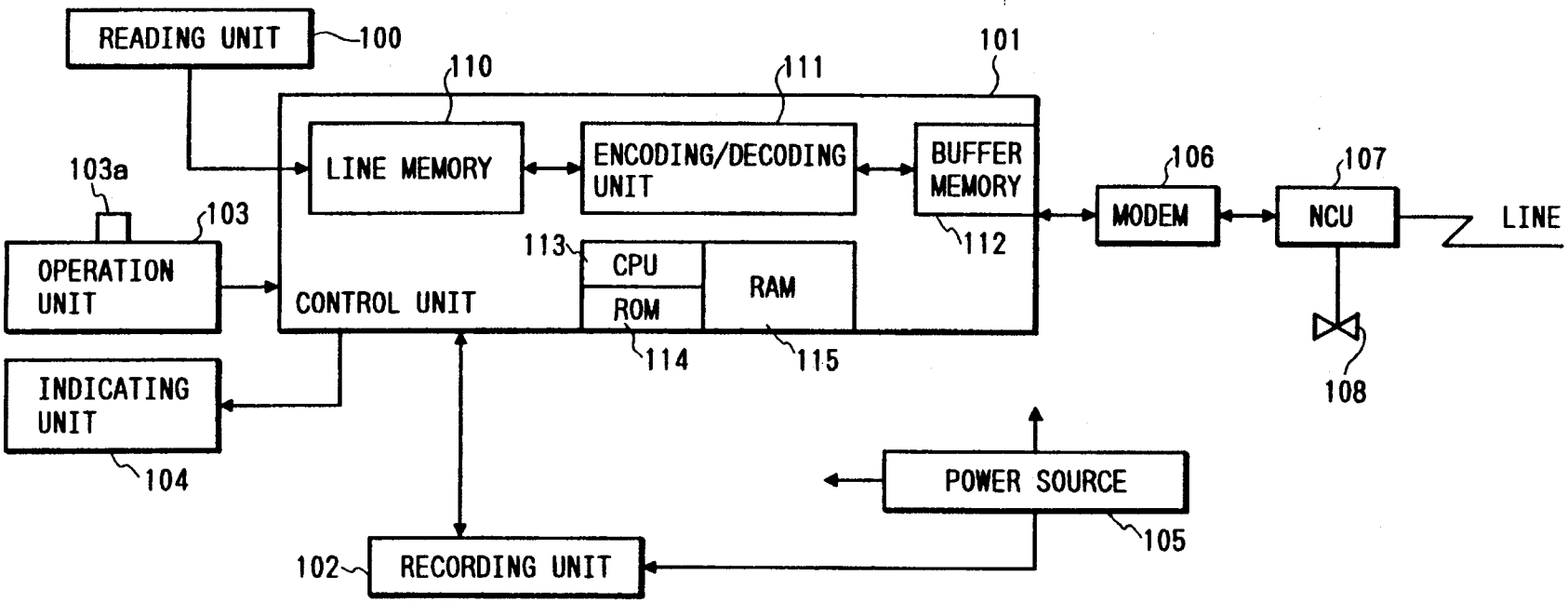
FIG. 2 is a block diagram to show the outline of the composition of the facsimile machine which is an embodiment of the present invention.

FIGS. 1–4 are drawings to show the facsimile equipment used as the thermal printer of the embodiment of the present invention. FIG. 1 is the drawing to show the electric connection between the control unit and the recording unit; FIG. 2 is the block diagram to show the outline of the composition of the facsimile equipment; FIG. 3A is the drawing of the side section of the facsimile equipment and FIG. 3B is the perspective view of its appearance.

Based on FIG. 2, the outline of the composition shall be explained.

In FIG. 2, 100 is the reading unit to read the manuscript photoelectrically and output it as digital image signal to the control unit 101 of the own equipment (in case of copy mode) or of other equipment (in case of facsimile mode), and the unit is provided with the motor to convey the manuscript, CCD image sensor etc. Next the composition of the control unit 101 is explained. First, 110 is the line memory to store the image data of each line of the image data. At the line memory 110 is stored the image data of one line conveyed from the reading unit 100 for transmission (facsimile mode) or copying (copy mode) of the manuscript while at the reception of image data, it stores one line of decoded image data received. Image is formed when thus stored data are output at recording unit 102. While 111 is an encoding/decoding unit to encode the received image information by MH encoding and decode the encoded image data received and convert it into image data. 112 is a buffer memory to store the encoded image data received or to be transmitted. Each of these sections of the control unit 101 is controlled for example by the CPU 113 of the microprocessor. The control unit 101 is provided with, in addiron to CPU 113, the control program of CPU 113 and ROM 114 which memorize various data, RAM 115 which temporarily stores various data operating as the work area of CPU 113.

102 is the recording unit to execute recording of image on the recording sheet by thermal transfer recording method which is provided with the thermal line head having a plurality of heat generating devices 132 to cover the entire recording width.

The arrangement regarding the recording unit 102 shall be explained in detail later with reference to FIG. 1. 103 is the operation unit which includes keys to instruct various function such as start of signal transmission, the key to input telephone number, etc. **103*a* is the switch to designate the kind of ink sheet 14 to be used, ON of this switch 103*a* indicating the setting of multi-print ink sheet and OFF indicating the setting of ordinary ink sheet. 104 is normally provided to operation unit 103 which is the indicating unit to indicate the state of various function and equipments, remaining amount of ink sheet, etc. 105 is the power source unit to supply power to the entire equipment. 106 is the modem to execute AC/DC conversion of the signals (modulator-demodulator); 107 is the net control unit (NCU) to execute communication control with the circuits and 108** is the telephone provided with the key to input telephone number etc.

Figure 3A:
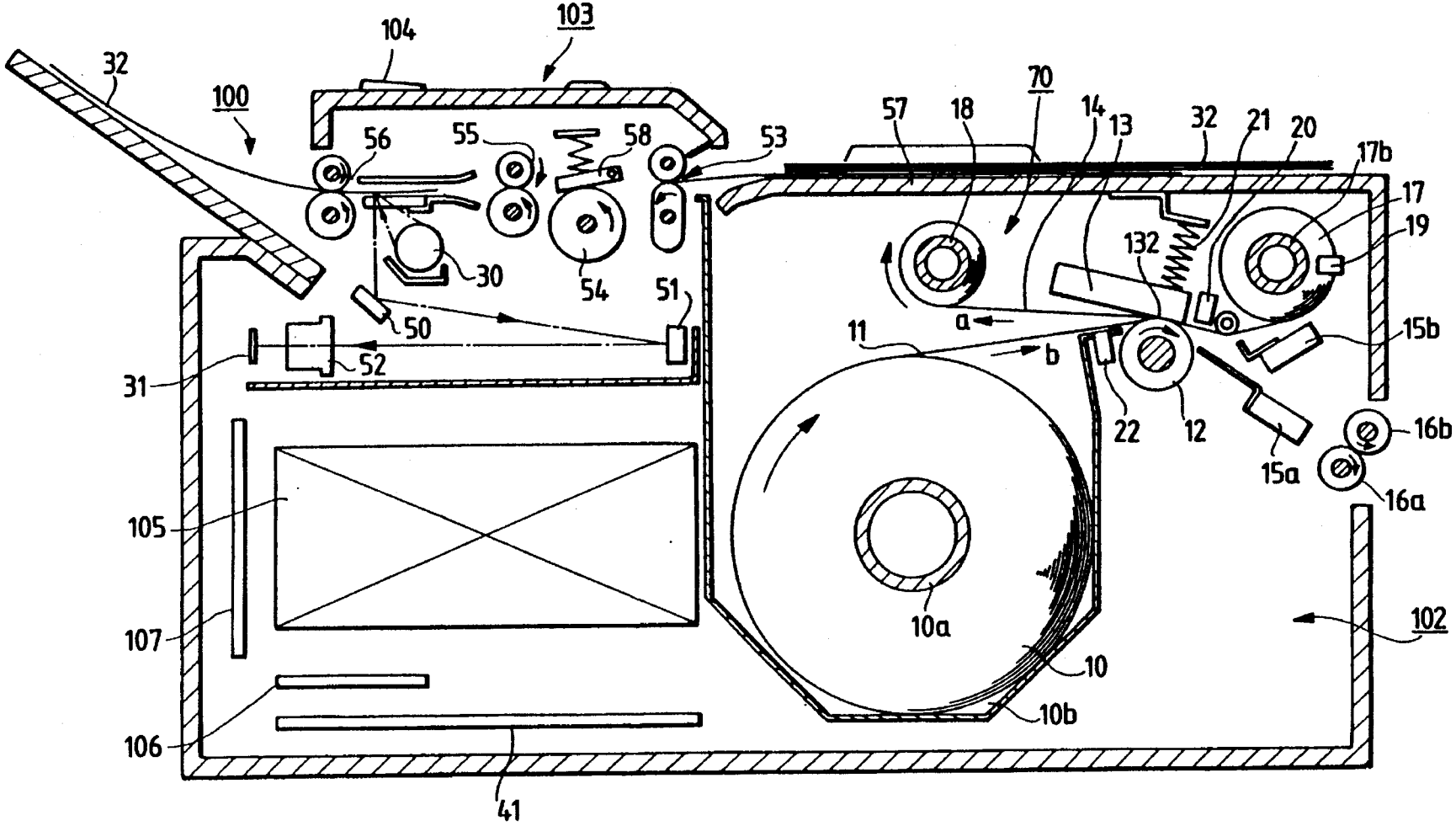
FIG. 3A is a drawing of the side section of the structural part of the facsimile machine which is an embodiment of the present invention.
Figure 3B:
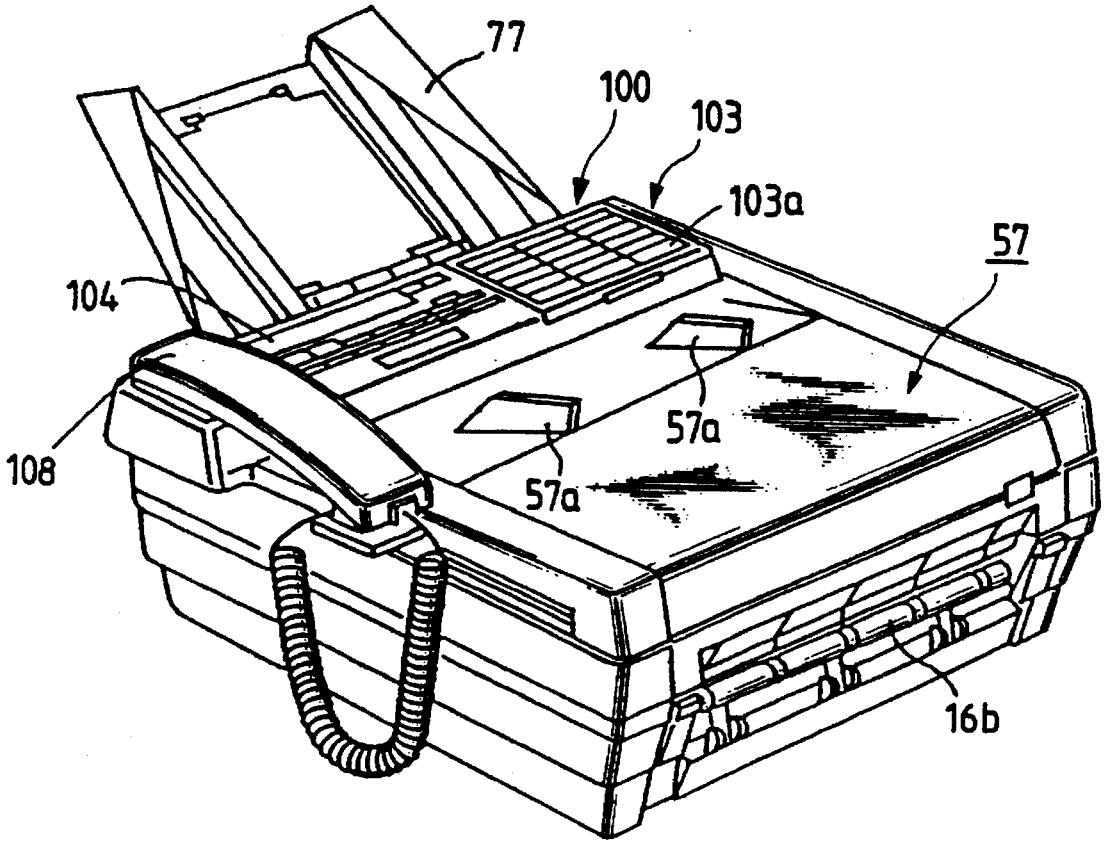
FIG. 3B is a perspective view of the appearance of the facsimile machine.

Next the arrangement of recording unit 102 is explained in detail in reference to the drawing of side section of FIG. 3A. The parts common with those of FIG. 2 are indicated by the same number.

Figure 10:
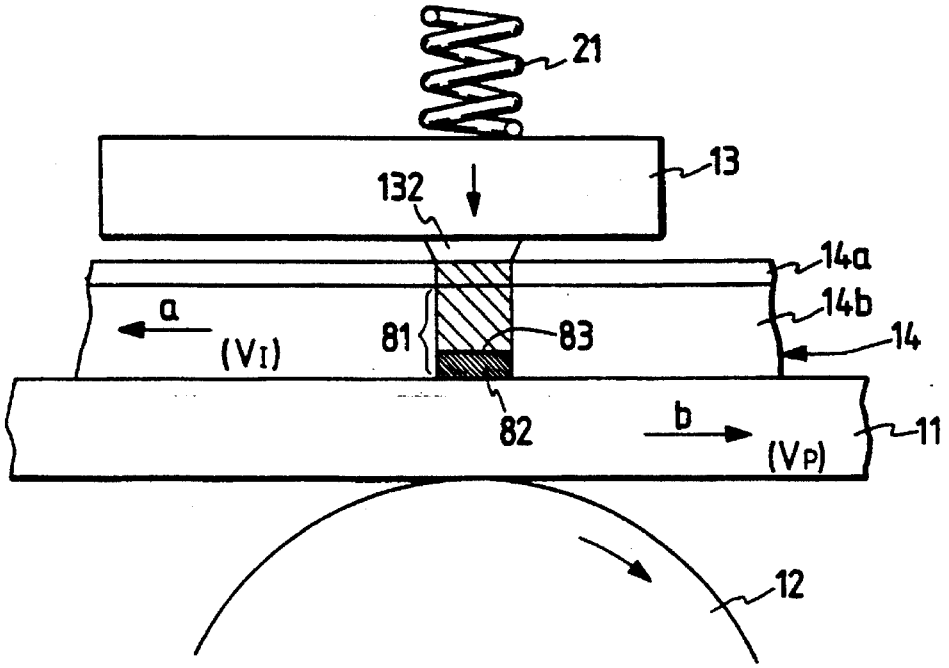
FIG. 10 is a drawing to show the state of the recording sheet and the ink sheet at recording according to the present embodiment.

In FIG. 3A, 10 is the rolled sheet which rolls up the recording sheet 11, which is the ordinary sheet, on the core **10*a*. This rolled sheet 10 is rotatably housed in the unit so that the recording sheet 11 can be delivered to the recording position where thermal head 113 exists as the platen roller 12 rotates in the direction of arrow. 10*b* is the unit at which rolled sheet is set, rolled sheet 10 being set in the way that it can be mounted or dismounted as desired. 12 is the platen roller which conveys the recording sheet 11 in the direction of arrow b. This platen roller 12 presses the ink sheet 14 and recording sheet 11 against the heat generating member 132 of thermal head 13. Recording sheet 11 on which image is recorded due to heat generation of such heat generating member 132 of the thermal head 13 is conveyed in the direction of discharge roller 16 (16*a*, 16*b*) by further rotation of platen roller 12, and when recording of image of one page is completed, it is cut into one page lengths by the gearing of the cutter 15 (15*a*, 15*b***) and discharged.

17 is the ink sheet feed roll which rolls up the ink sheet 14, 18 is the ink sheet wind up roll, which is driven by the ink sheet driving motor to wind up the ink sheet 14 in the direction of arrow a. This ink sheet feed roll 17 and ink sheet wind-up roll 18 are mounted at the ink sheet mounting unit 70 in the main body of the device in the way that it can be mounted on and off.

19 is the sensor to detect the remaining amount and the conveying speed of ink sheet 14. 20 is the ink sheet sensor which detects whether ink sheet 14 exists or not and detect the remaining amount of ink sheet 14 based on the mark given to the ink sheet 14. 21 is the spring which presses the thermal head 13 against the said platen roller 12 via the recording sheet 11 and ink sheet 14. 22 is the recording sheet sensor to detect whether recording sheet still exists or not.

Next the arrangement of the reading section 100 is explained. In FIG. 3A, 30 is the light source to irradiate the manuscript 32 wherein the light reflected by the manuscript 32 is input into CCD sensor 31 through the optical system (mirrors 50 and 51, lens 52) and converted into electric signal. Manuscript 32 is conveyed by the conveying rollers 53, 54, 55 and 56 which are driven by the manuscript conveying motor (not shown) in accordance with the speed of reading of manuscript 32. 57 is the manuscript table and plural manuscripts loaded on this table 57 are separated one by one by the synchronized motion of conveying roller 54 and pressure separating piece 58 while being guided by slider **57*a* and conveyed to reading unit 100 and after reading, the manuscript 32 is discharged into the tray 77**.

41 is the control panel to make up the main section of control unit 101 and various control signals are output from this control panel 41 to each part of the device. 106 is the modem panel unit and 107 is NCU panel unit.

Figure 4A:
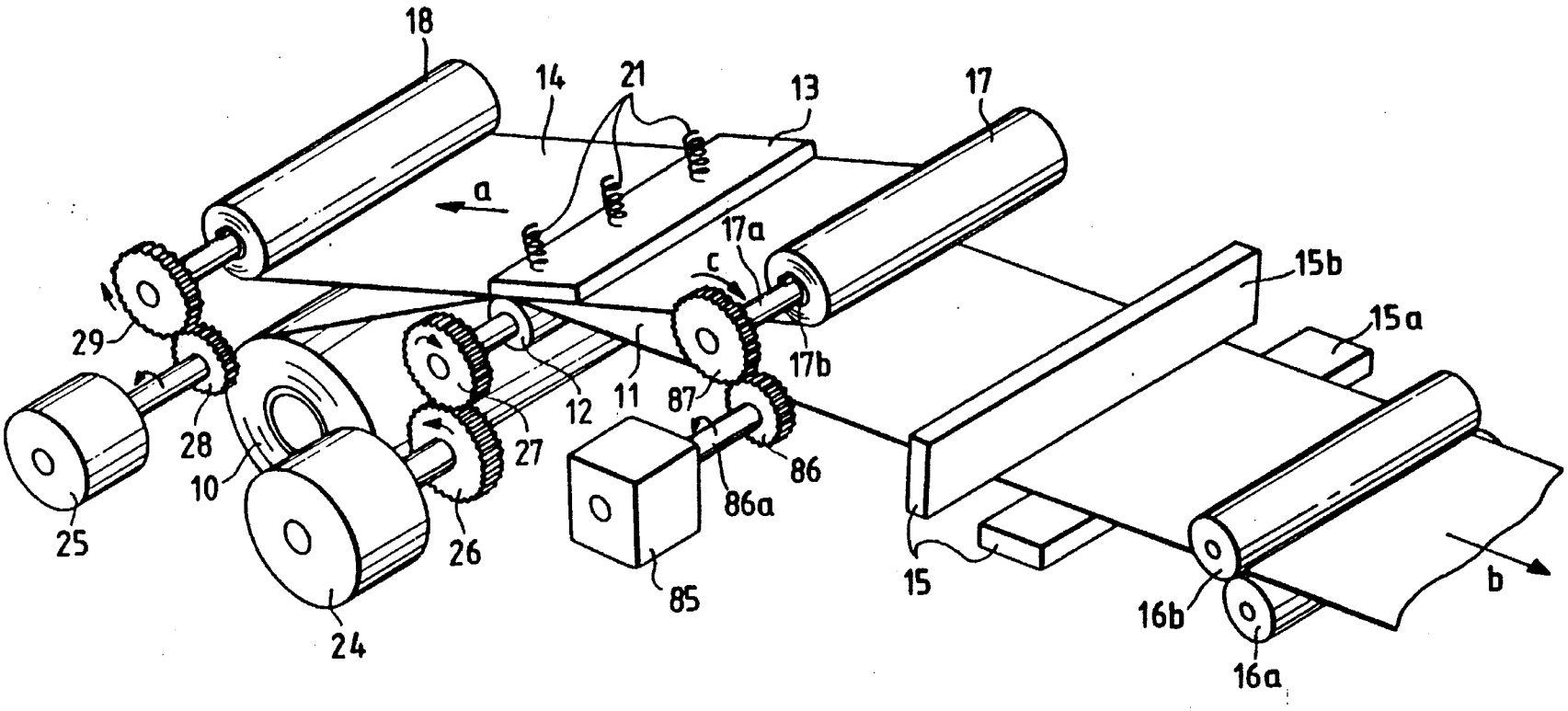
FIGS. 4A and 4B are the drawings to show the construction of the conveying system of the ink sheet and the recording sheet.
Figure 4B:
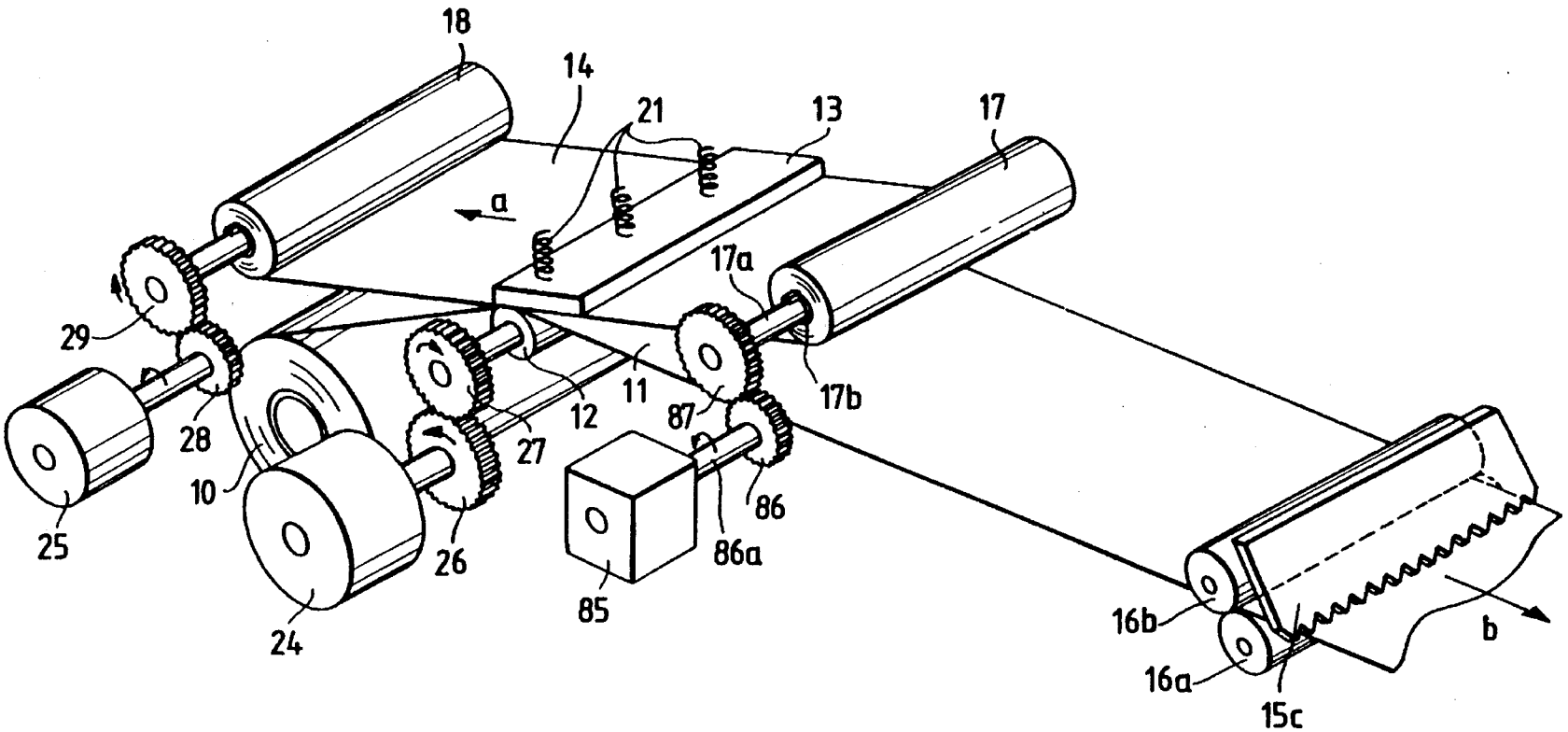

FIGS. 4A and 4B are the drawings to show the details of conveying mechanism of recording sheet 11. The same parts given in the prior drawing are given the same number and their explanations are omitted here.

In FIG. 4A, 25 is the ink sheet conveying motor to convey the ink sheet 14 in the direction of arrow a and 24 is the recording sheet conveying motor to convey the recording sheet 11 in the direction of arrows b which is opposite to the direction of arrow a. 28 and 29 are transmission gears to transmit the rotation of ink sheet motor 25 to the wind-up roller 18. 85 is the torque limiter which applies load to the rotation of ink sheet feed roll 17, via the transmission gears 86 and 87, such load being applied when the ink sheet feed roll 17 rotates in the direction of arrow c as ink sheet 14 is fed.

This torque limiter 85 is provided at the edge of the shaft 86a of the aforesaid transmission gear 86. In this embodiment, the torque limiter 85 is so set that it applies the load of about 1.6 kg. cm on the axis 17*a* of ink sheet feed roll 17. In the present embodiment, the diameter of the ink sheet roll 17 changes, as the ink sheet 14 is fed, from about 44 mm (at the beginning of use) to about 19 mm (at the end of use—it is equivalent to the diameter of the core 17*b*) and therefore the tension applied to the ink sheet 14 gradually changes from about 0.36 kg to about 0.84 kg.

When the direction of conveyance of recording sheet 11 is reversed so it is opposite to the direction of conveyance of ink sheet 14, the direction in which images are sequentially recorded on the recording sheet 11 along its length (the direction of arrow a, i.e., the direction opposite to the direction of conveyance of the recording sheet 11) is the same as the direction in which the sheet 14 moves . When the conveying speed $V_p$ of recording sheet 11 is assumed to be $V_p=-n\cdot V_I$ ($V_I$ is the conveying speed of ink sheet 14 and—indicates that the conveying direction of recording sheet 11 differs from the conveying direction of ink sheet 14), the relative speed $V_{PI}$ of recording sheet 11 and ink sheet 14 as against the thermal head 13 may be expressed by $V_{PI}=Vp-V_I=(130\ 1/n)\ V_p$, which indicates that such relative speed $V_{PI}$ is more than $V_p$, that is, it is larger than the relative speed $V_{PI}'(=(1-1/n)\ V_p)$ of the case when the sheets are conveyed in the same direction as in the case of the conventional system.

In the case of the facsimile as shown by the present embodiment, the time of encoding/decoding varies considerably depending on the respective image information in the case of facsimile mode and therefore the conveying speed is not constant. In the case of the present embodiment, explanation shall be made on copy mode where recording is done at a constant speed.

In the case of the present embodiment, conveying speed of recording sheet 11 at the time of recording is $V_p\cong 26$ (m m/S), $n\cong 5$ and therefore conveying speed of ink sheet 14 becomes $V_I-5.2$ (m m/S).

Beside the above, there is a method wherein ink sheet 14 is conveyed in the direction of arrow a by (l/m) (m is integral number and n>m) for each (n/m) line when recording is made for n line by thermal head 13. There is also the method that when the distance corresponding to the length L is recorded, ink sheet 14 is conveyed at the same speed but in the reverse direction to the direction of motion of recording sheet 11 and prior to succeeding recording of the preset amount, the ink sheet 14 is rewinded for $L\cdot(n-1)/n$ (here n>1). In either of the above cases, the relative speed at which recording is made while keeping the ink sheet 14 standstill is $V_p$ and the relative speed of recording while the ink sheet 14 is in motion is $2V_p$.

FIG. 4B is the device wherein manual cutter 15C is provided at the downstream side of the discharge roller 16 is instead of cutter 15. Even when the device has such construction that manual cutter 15C is provided, the similar effect may be obtained by exercising conveying control as long as it is assumed that there is no back feed procedure as stated later.

Hereunder explanation is made on the device shown in FIG. 4A.

FIG. 1 shows the connection of electric system of control unit 101 and recording unit 102 of the facsimile of the present example of embodiment wherein the parts common with those of other drawings are given the same number.

Thermal head 13 is a line head as stated before. This thermal head 13 is provided with the shift register 130 to input serial recording data 43 for one line which are delivered from control unit 101, latch circuit 131 to latch the data of shift register 130 by latch signal 44 and heat generating apparatus 132 which is composed of heat generator for one line. Here heat generating resistor 132 is driven by being divided into m pieces of blocks indicated by 132-*l*–132-*m*. 133 is the temperature sensor to detect the temperature of thermal head 13. The output signal 42 of this temperature sensor 133 is A/D converted in the aforesaid control unit 101 and input into CPU 113. Thereby CPU 113 detects the temperature of thermal head 13 and according to the detected temperature, it changes the pulse width of strobe signal 47 or changes the driving voltage of thermal head 13, thereby changing the energy impressed on the thermal head 13 in response to the characteristics (kind) of ink sheet 14 used.

The kind (characteristics) of the ink sheet 14 is instructed by the switch 103*a*. It may alternatively so arranged that the kind and characteristics of ink sheet 14 is automatically detected by the mark etc printed on the ink sheet 14. Or, alternatively it may be so arranged that judgement is made based on the mark given to the cartridge of the ink sheet or the notch or projections provided to the cartridge.

46 is the driving circuit to output the strobe signal 47 which inputs the driving signal of thermal head from the aforesaid control unit 101 and drives the thermal head 13 block by block. This driving circuit 46 can change the voltage output to the power source cable 45 which feeds current to the heat generating apparatus 132 of the thermal head 13 according to the instruction of the control unit 101 and thereby change the energy impressed on thermal head 13. 48 and 49 are motor driving circuits which respectively drive and rotate the motor 24 for conveying recording sheet and motor 25 for conveying ink sheet. In the present embodiment, the motor 24 used for conveying the recording sheet and the motor 25 for conveying ink sheet are stepping motor but they are not limited thereto and they may be for example DC motor.

Explanation of the 1st Embodiment (FIGS. 5–9)

Figure 5:
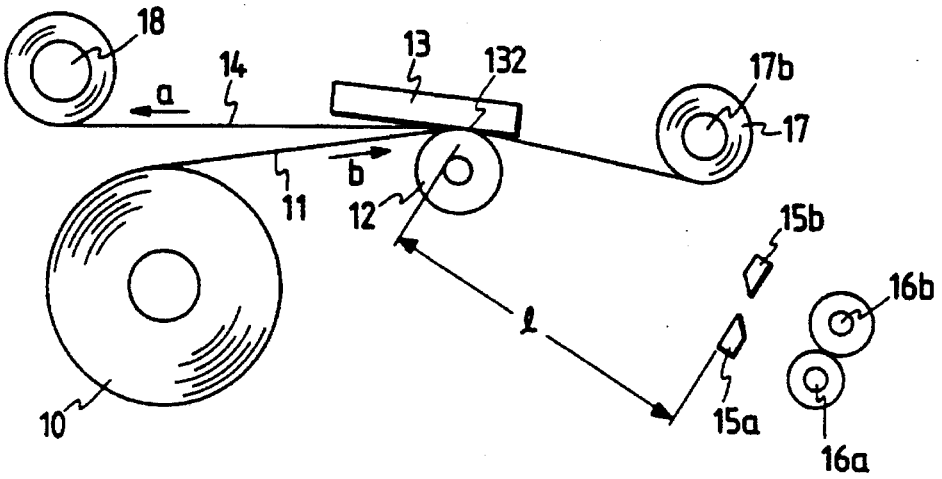
FIGS 5–9 are the drawings to show the movement of the recording sheet and ink sheet of the facsimile machine, the embodiment of the present invention.

FIG. 5 is the drawing to show the state of recording sheet 11 and ink sheet 14 at standby time before starting the recording action. It is so arranged that the point near the front end of the recording sheet 11 comes to the recording position of thermal head 13 (to add the desired amount of margin to the front end of the position where recording is started). When image recording is started in such state, the recording sheet 11 is conveyed in the direction of arrow b at the speed $V_p$ and ink sheet 14 is conveyed in the direction of arrow a at speed $V_I$. The relation between these two conveying speeds $V_p$ and $V_I$ are so set that $V_p=-n\ V_I$ is established. (In the present embodiment, $V_p=26$[mm/S], n=5, $V_I=-5.2$[mm/S]). –indicates that the direction of conveying of recording sheet 11 differs from that of ink sheet 14.

Figure 6:
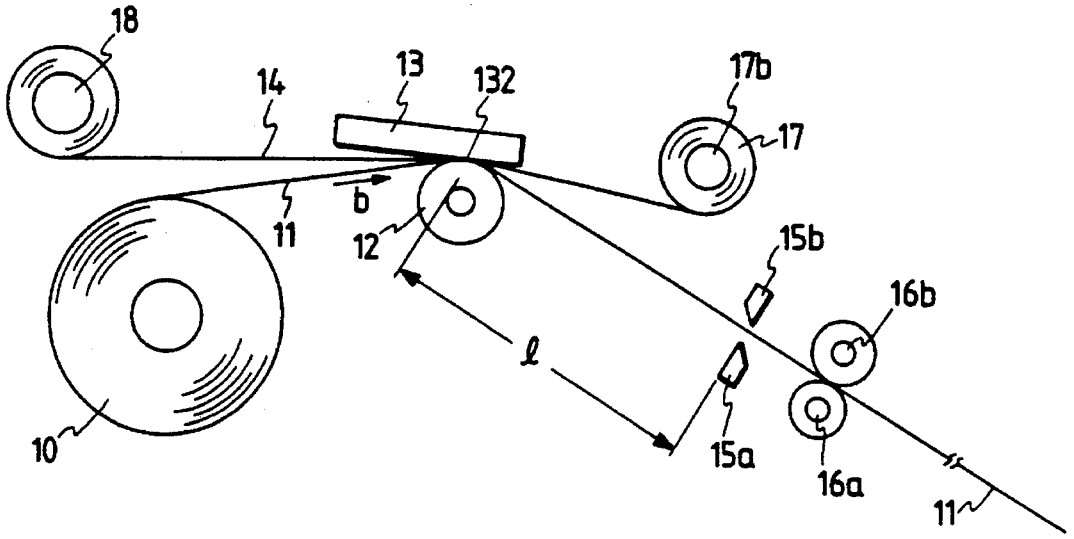

FIG. 6 shows the state where image recording for one page is completed. Here, the rear edge of one page where image was recorded is brought in contact with thermal head 13. Therefore in order to cut the sheet for one page length by the cutter 15, it is necessary to convey the recording sheet 11 further forward (direction of arrow b) by the length "l" which is the distance between the recording position of thermal head 13 and cutter 15.

Figure 7A:
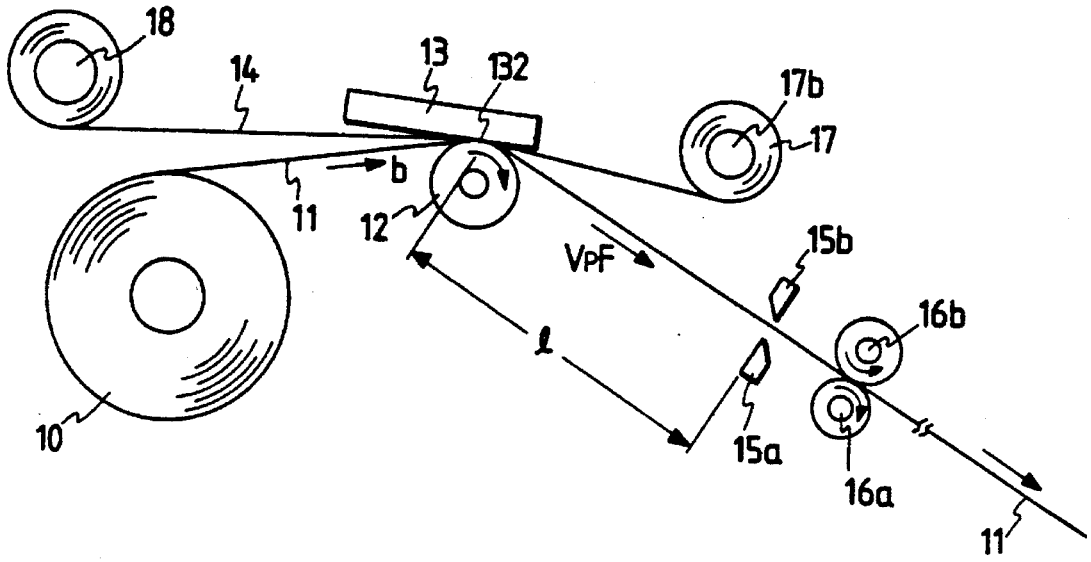

FIG. 7A is the drawing to show the state at the time of such conveying wherein the conveying speed of recording sheet 11 is assumed to be $V_{PF}$ (in the present embodiment, $V_{PF}\cong 52$[mm/S]). While the ink sheet 14 is strained as being loaded with a tension while it stops in between the ink sheet feed roll 17 and wind-up roll 18 due to the holding torque of ink sheet conveying motor 25. In other words, as stated later, ink sheet conveying motor is stopped by fixing the phase excitation signal of ink sheet conveying motor 25 by the driving circuit 49. Thereby holding torque is produced at motor 25 and windup roll 18 is restricted of its rotation. Under such condition, ink sheet 14 received the force to move in the direction of arrow b from the recording sheet 11 which is moving forward (direction of arrow b). However since the rotation of wind-up roller 18 is restricted, ink sheet 14 can not proceed in the direction of arrow b and thus tension is loaded and the sheet is strained.

Figure 8:
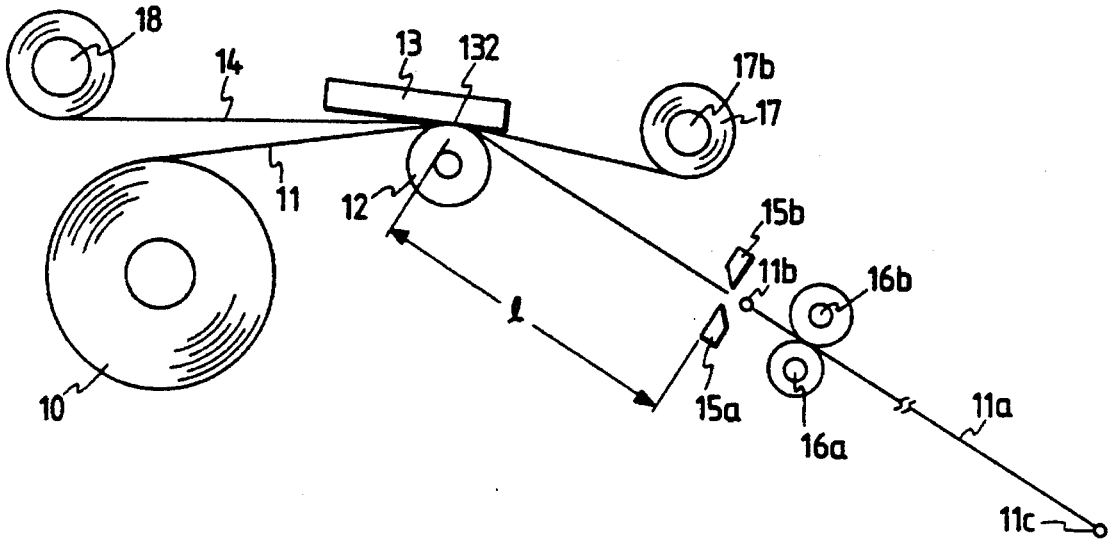

When the recording sheet is carried to such position that the point near the rear edge of the recording sheet 11 on which image has been recorded passes through the cutting position by cutter 15 so that the sheet is cut by leaving the present margin at the rear edge of the image, the motor for driving the cutter 15 (not shown) drives by the instruction of control unit 101 and moving blade 15*a* and fixed blade 15*b* gear with each other and recording sheet is cut for one page length. FIG. 8, 11*a* is one page length of recording sheet duly recorded; 11*b* is the rear edge of one page of recording sheet 11*a* which has been cut and 11*c* is the front edge of one page of recording sheet 11*a* having been cut.

Figure 9:
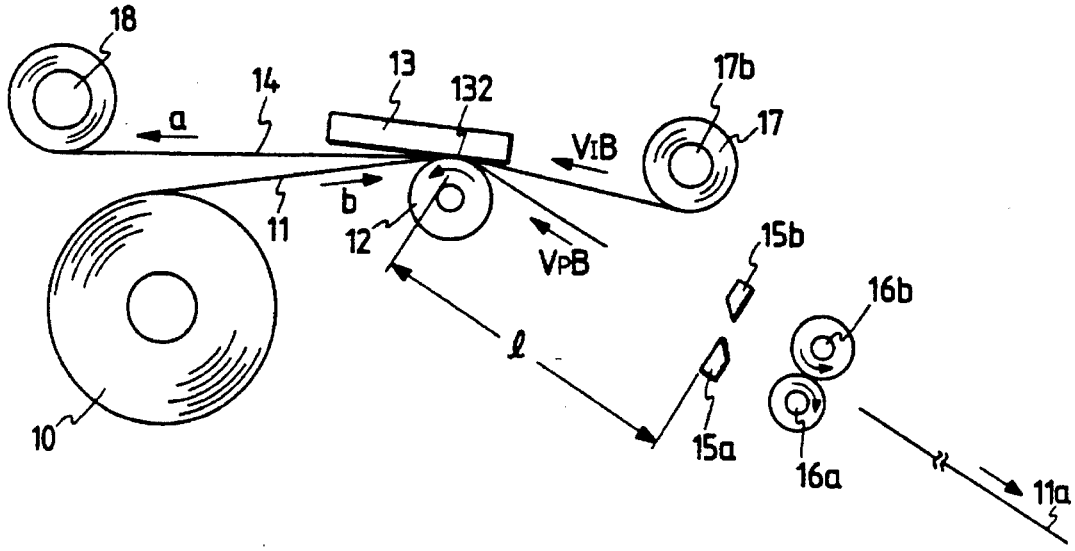

FIG. 9 is the drawing to show the state wherein the recording sheet 11 is rewinded in the direction opposite to the direction of arrow b of FIG. 7A, after cutting of recording sheet 11, conveying it to the position where the front edge of the recording sheet 11 projects somewhat from the transfer position of thermal head to the side of sheet discharge roller 16 and thus projecting the sheet front for recording of the succeeding page. The speed of rewinding of recording sheet 11 at such time is assumed to be $V_{PB}$ (in the present embodiment, $V_{PB}\cong -52$[mm/S]. At this time, ink sheet 14 is pulled by the recording sheet 11 in the direction opposite to the direction of arrow b. As stated above, the rotary axis 17*a* of ink sheet feed roll 17 bears the load of torque limiter 85. Therefore, when the force required to pull ink sheet 14 in the direction of arrow a exceeds torque limiter 85, the ink sheet 14 is moved backward (direction of arrow a) at a speed slower than the speed $V_{PB}$ of recording sheet 11. The amount of such shift offsets the difference between the conveying force given by the friction between the ink sheet 14 and recording sheet 11 and the holding force given by the load of torque limiter 85. Simultaneously, the recording sheet 11*a* which was recorded and cut is discharged to outside the apparatus by the rotation of discharge roller 16.

As aforesaid, in the conveying of recording sheet 11 forward for cutting, holding torque is produced at the ink sheet conveying motor 25 by fixing the phase excitation signal of the said motor 25. By such holding torque, the rotation of wind-up roller 18 is restricted and thereby the ink sheet 14 is kept standstill while being strained. At the time of conveying of recording sheet 11 backward, the ink sheet 14 is moved in the winding-up direction at the speed slower than the speed of recording sheet 11 by the amount corresponding to the amount in excess of the loading torque of torque limiter 85. In this way, the amount of move of ink sheet 14 which may be accompanied by the conveying of recording sheet 11 is minimized.

In the standby state before image recording (shown in FIG. 5), the ink sheet 14 must be spread without sagging between the ink sheet wind-up roll 18 and thermal head 13. It is because, at the start of image recording when ink sheet wind-up roll 18 is driven for rotation and conveying of ink sheet 14 starts, if ink sheet is sagging, the rotation of wind-up roll 18 only absorbs the sag of ink sheet 14. If so, when the image recording starts, the speed of conveying of ink sheet 14 is not equal to $V_1$. Besides, the ink sheet 14 is drawn by the conveying of the recording sheet 11 at the speed $V_P$ and sometimes it is carried to the downstream side.

In the aforesaid example of embodiment, when projection of recording sheet 11 completes, the aforesaid offsetting amount of ink sheet 14 becomes the sag between the ink sheet wind-up roller 18 and platen roll 12. Therefore before the succeeding recording starts, this sag must be eliminated so that the sheet is spread with appropriate tension.

Therefore in the present example of embodiment, at the time of back feed of the recording sheet 11 (conveying in the direction opposite to arrow b), ink sheet 14 is completely strained by conveying it in the same direction (direction of arrow a) after completion of rewinding of recording sheet.

Figure 7B:
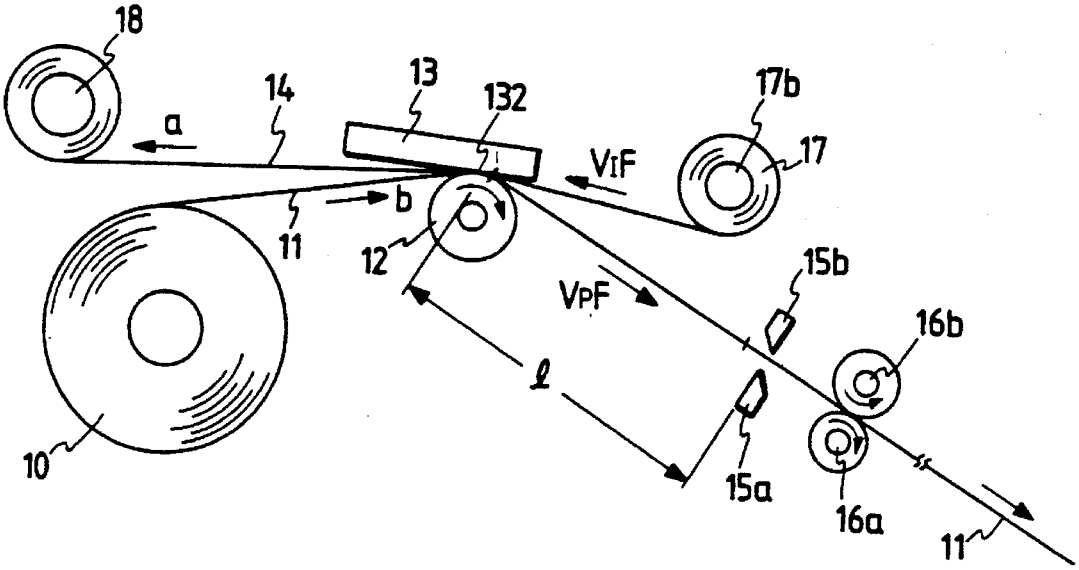

The second embodiment (FIGS. 7B and 9)

In reference to the second example of embodiment, explanation shall be made on the case of conveying the ink sheet forward in such way that at the time of front feed of recording medium, the ratio of the absolute value of the conveying speed of the conveying ink sheet to the absolute value of the conveying speed of the recording medium becomes larger than their speed ratio at the time of recording.

In the second example of embodiment, at the time of front feed of the recording sheet 11, the ink sheet 14 is conveyed in the direction of arrow a at speed $V_{IF}$ by the rotation of the ink sheet conveying motor 25 as shown FIG. 7B. At the time of back feed of recording sheet 11, ink sheet 14 is moved in the direction of arrow a at the speed slower than the recording sheet 11 due to the load of the torque limiter 85 and the friction of recording sheet 11 and ink sheet 14 as stated above.

In this second example of embodiment, when the recording sheet 11 is conveyed in the direction toward discharge roller 16, the conveying speed $V_{IF}$ of ink sheet 14 is set at $V_{PF}/n_{IF}$ as against the conveying speed of recording sheet of $V_{PF}$ (in this embodiment, $V_{PF}=52$[mm/S]). Here $n_{IF}>n$ (n is equal to n during recording). This $n_{IF}$ is the maximum value which does not cause staining of the recording sheet 11 due to friction between ink sheet 14 and recording sheet 11. For example, when $$n_{IF}=10,\ V_{IF}=-5.2[mm/S].$$

As given above, at the time of front feed of recording sheet 11 for cutting to one page lengths, when the ink sheet 14 is conveyed at a slower speed, staining of the ink sheet 14 is prevented and waste of sheet due to conveying may be reduced.

The third embodiment

The third embodiment is the case where, in the aforesaid first and second embodiment before starting recording, ink sheet 14 is further winded up to eliminate the sag of the ink sheet 14.

Before starting recording, the ink sheet conveying motor 25 is driven for rotation and ink sheet 14 is conveyed in the direction of arrow a for wind-up and it is checked if ink sheet feed roll 17 is rotating or not by the ink sensor 19. If rotation is not detected, the ink sheet conveying motor 25 is further caused to rotate. When the rotation of feed roll 17 is detected by ink sheet sensor 19, it is so judged that ink sheet 14 has been spread without sagging. According to this embodiment, in the standby state, ink sheet 14 is spread without sagging between the ink sheet wind-up roll 18 and thermal head 13. Therefore at the start of image recording, when ink sheet wind-up roll 18 is rotated and conveying of ink sheet 14 starts, the ink sheet 14 is conveyed at the specified speed $V_I$. Thus it is possible to prevent that the ink sheet 14 is drawn by the recording sheet 11 which is moving at the speed $V_P$ and carried over to the downstream side.

The fourth embodiment (FIGS. 7B and 9))

In reference to the fourth embodiment, explanation shall be made on the case where the said ink sheet is conveyed in such way that the ratio of speed of the ink sheet and the recording medium becomes equal to the speed ratio at the time of recording, at the back feed of recording medium. In the fourth example of embodiment, in the case of front feed of recording sheet 11, the ink sheet conveying motor 25 is driven for rotation and ink sheet 14 is conveyed in the direction of arrow a at the speed $V_{IF}$=−10.4[mm/$s_I$] which is equal to the speed ratio of the recording sheet 11 during recording and likewise in the case of back feed, the ink sheet 14 is conveyed in the direction of arrow a at the speed ratio of $V_{IB}$=−10.4[mm/S] ($V_{IB}=V_{PB}/n$) which is equal to the speed ratio during recording ($V_{PB}$=−52[mm/S].

In the embodiment 3, at the time of back feed, when the amount conveyed by ink sheet conveying motor 25 (l/n) is larger than the distance of moving of ink sheet 14 in the direction a which is caused by the pull of the recording sheet 11 back-fed by the load of torque limiter 85, the ink sheet 14 is spread without sagging.

As aforesaid, in the present embodiment, the ink sheet 14 being recorded is conveyed at a speed $V_I$ given by $V_P=nV_I$ (in the case of back feed, $Vp = nV_I$) maintaining the relation of $V_P=-nV_I$ which is the relation of ink sheet 14 and recording sheet 11, at the time of front feed as well as back feed of recording sheet 11 for cutting of recording sheet 11 in page lengths. Therefore, according to the present embodiment, it is possible to simplify the control program to execute such recording and prevent staining of the recording sheet and sagging of ink sheet.

Figure 11:
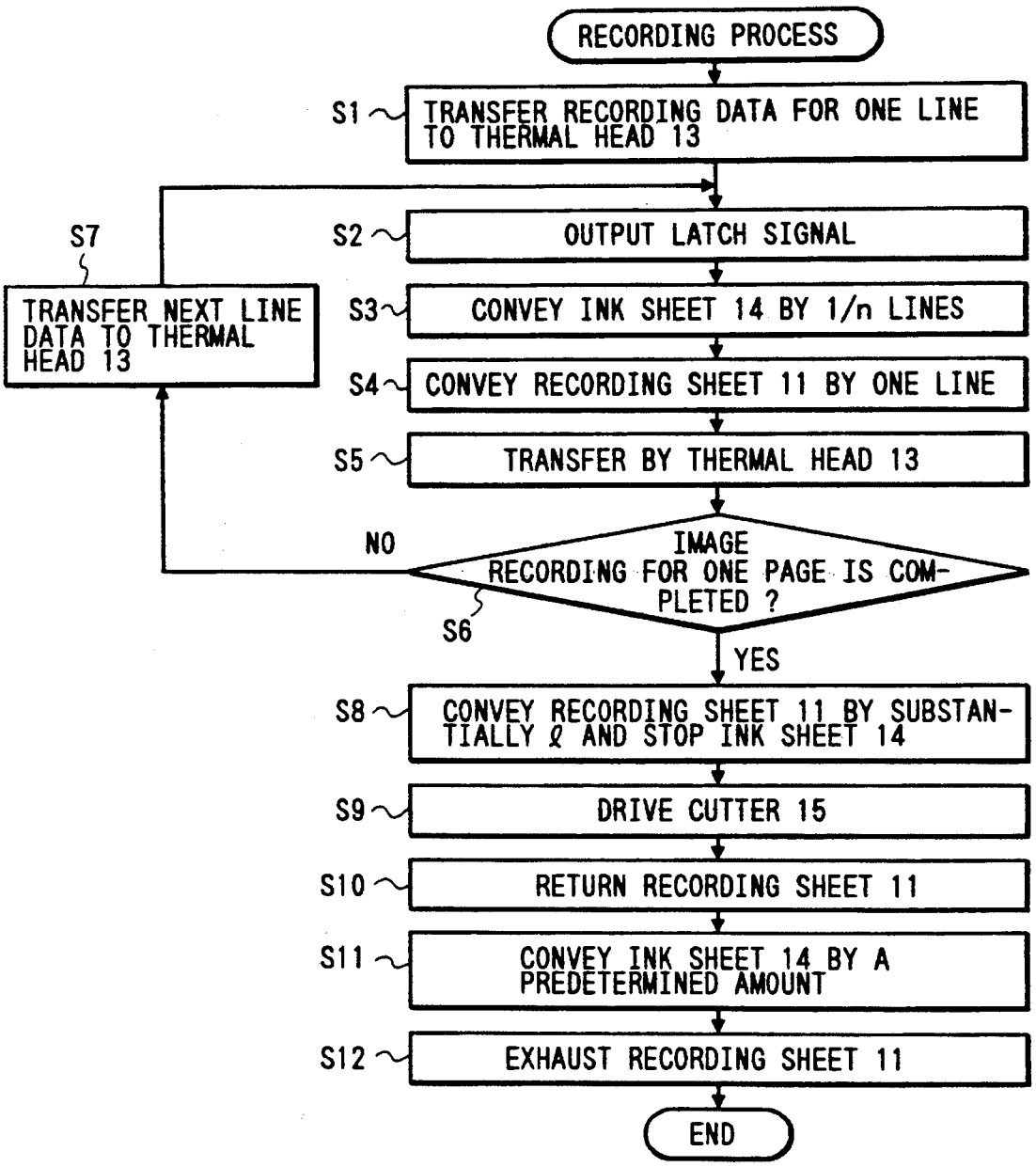
FIG. 11 is the flow chart to show the recording process of the facsimile machine which is the embodiment of the present invention.
Figure 12:
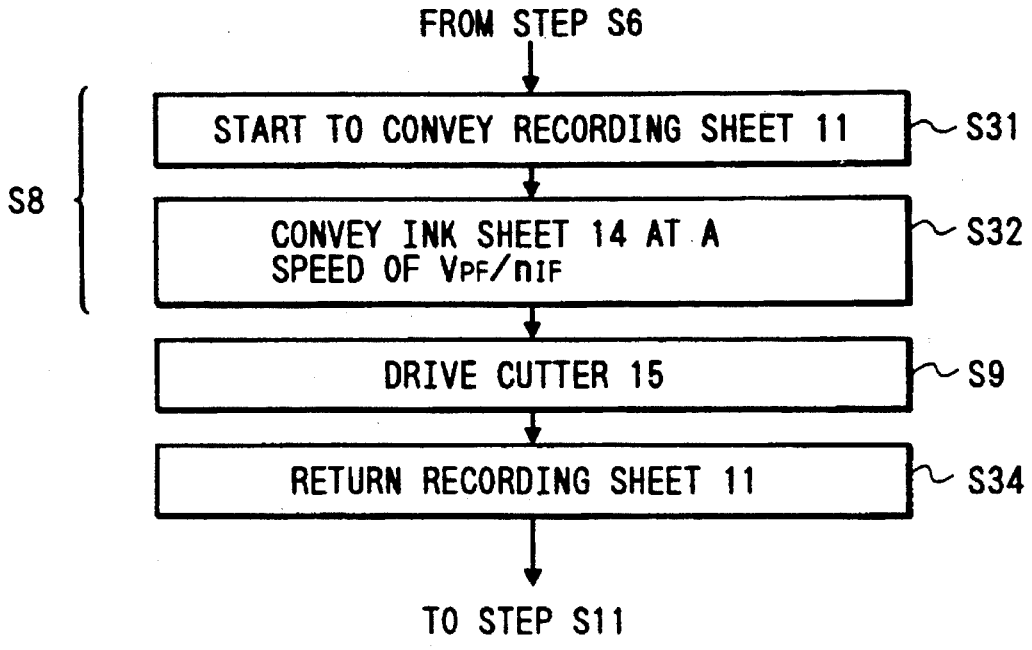
FIG. 12 is the flow chart to show other method of processing of step S10 shown in FIG. 11.

Explanation of recording action (FIGS. 11–12)

FIG. 11 is the flow chart to indicate the recording process of facsimile according to the first embodiment. The control program to execute such recording process is memorized in ROM 114 of control unit 101.

This process begins when the image data for one line to be recorded are stored in line memory 110 and the apparatus becomes ready for recording. First at step S1, recording data for one line are output in series on to the shift register 130. When transfer of recording data for one line is completed, latch signal 44 is output at step S2 and recording data for one line is housed in the latch circuit 131. Then in the following step S3, ink sheet conveying motor 25 and ink sheet feeding motor 85 are driven to convey ink sheet 14 for (l/n) line to the direction of arrow a in FIG. 3. At step 4, the recording sheet conveying motor 24 is driven to convey the recording sheet 11 for one line to the direction of arrow b. The length of one line corresponds to the length of 1 dot to be recorded by the thermal head 13.

Then the mode proceeds to step S5 wherein each block of heat generating apparatus 132 of thermal head is electrified one after another. When image recording for one line is completed,by electrifying all of m blocks, the mode proceeds to step S6 to see if image recording for one line has been completed or not. When image recording for one page is not complete, it proceeds to step S7 and the recorded data of the following line are transferred to the shift register 130 of thermal head 13. Then the mode returns to step S2 and image recording is conducted as aforesaid.

At step S6, if image recording for one page is completed, the mode proceeds to step S8 and the 10 recording sheet 11 is conveyed to the direction of discharge rollers **16*a* and 16*b* for the distance corresponding to the length l which is roughly the distance between the recording position of thermal head 13 and the cutter 15. As stated before, at this time, phase excitation signal of ink sheet conveying motor 25 is fixed by driving circuit 49 and ink sheet conveying motor 25 is stopped. In this way, the ink sheet 14 is held in the strained state in between the ink sheet feed roll 17 and ink sheet wind-up roll 18**.

Next in step S9, the mobile blade **15*a* is driven to gear with the fixed blade 15*b* and cuts the recording sheet 11 for page lengths. In step S10, the recording sheet 11 is fed back somewhat to have the edge of the sheet projects at the recording position. At this time ink sheet 14 moves backward at the speed slower than that of recording sheet, 11 to the extent in excess of the load of torque limiter 85, due to the friction of ink sheet 14 and the recording sheet 11. Next, in step S11, ink sheet conveying motor 25 is caused to rotate for the specified amount and ink sheet 14 is conveyed backward to absorb the sag and at step S12, the recorded sheet 11*a* is discharged to outside the apparatus by discharge roller 16**.

FIG. 12 is the flow chart to show the performance of the aforesaid second embodiment. It is realized by replacing the steps S8–S10 shown in FIG. 11 by the flow chart shown in FIG. 12.

At step S31, conveying of recording sheet 11 (in the direction of arrow b) is started and at step S32, the ink sheet 14 is conveyed in the direction of arrow a at speed $V_{IF}$ and it is strained by the load of torque limiter 85. In this way, the recording sheet 11 is conveyed for the length roughly correponding to the distance l which is from the recording position of thermal head 13 to the cutting position of cutter 15 and the ink sheet 14 is conveyed at the speed of $V_{IF}=-V_{PF}/n_{IF}$. Here, $n_{IF}$ is the figure larger than n mentioned above and it represents the number of sheets that can be conveyed without causing rubbing off of topcoat of ink sheet 14 by its abrasion with recording sheet 11. When the recording sheet 11 is cut by the cutter 15 at step S9, the mode proceeds to step S34 and recording sheet-11 returns by present amount to the direction of thermal head and the mode proceeds to step S11. At this time, ink sheet 14 is pulled in the direction of arrow a due to its abrasion with recording sheet 11 and by the action with the load of torque limiter 85, the ink sheet 14 is spread with strain in between the ink sheet feed roll 17 and platen roller 12.

When the motor 25 to convey the ink sheet is a stepping motor, the control of the value of the aforesaid n may be made by changing the step number of ink sheet 14 for conveying of one line of recording sheet 11 and the value n may be set by changing the minimum step angle of the motor by microstep driving.

Figure 13:
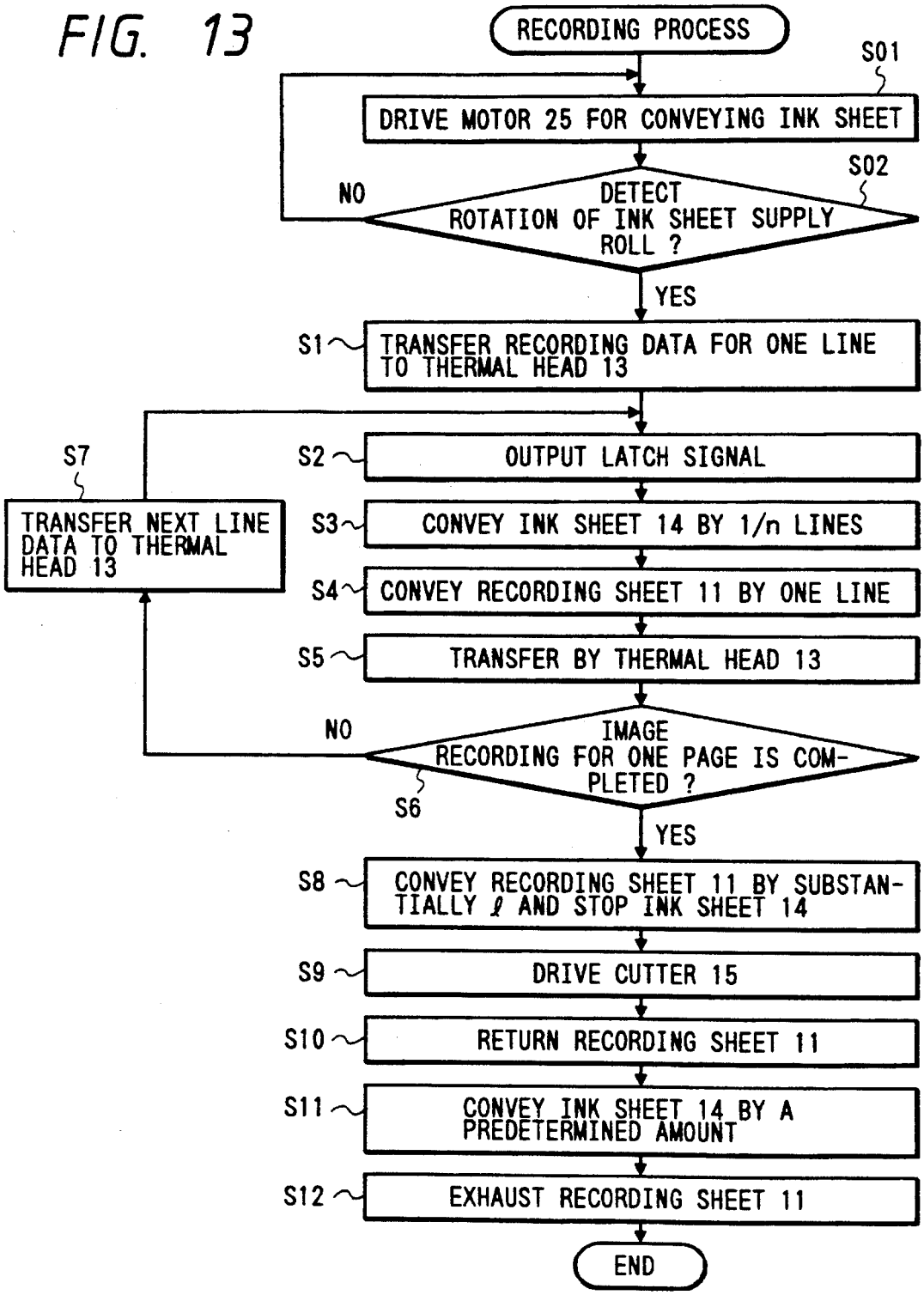

Since there is possibility that at step S12, ink sheet 14 sags in between the ink sheet wind-up roll 18 and platen roller 12, it may be so arranged that at the image recording of the following page, the step may be repeated from step S1 again. FIG. 13 is flow chart to show the performance of the aforesaid third embodiment. Here the step S01 are executed before step S1 shown in FIG. 11, while the process after step S1 is same as those of FIGS. 11 and FIG. 12, thus their explanation is omitted.

This process starts when the image data for one line is stored in the line memory 110 and the apparatus becomes ready for starting the recording action. At step S01, ink sheet conveying motor 25 is driven for rotation and ink sheet 14 is conveyed in the direction of arrow a and winded up. At step S02, the ink sheet sensor 19 checks if ink sheet feed roll 17 is rotating or not. When rotation is not confirmed, the mode returns to step S01 and ink sheet conveying motor 25 is further rotated. When rotation of feed roll 17 is detected by ink sheet sensor 19, it is so judged that the ink sheet 14 has been spread without sagging and the mode proceeds to step S1. Thereafter the performance is same as those of step S2—step S34 (FIG. 11 and FIG. 12) stated above.

Figure 14:
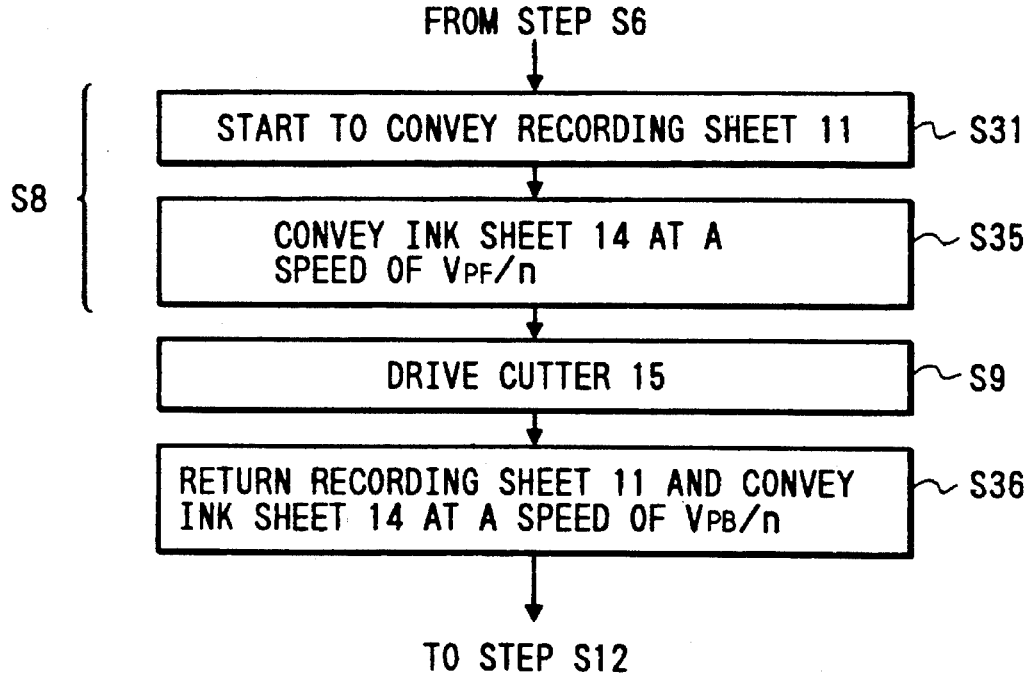
FIGS. 13 and 14 are the flow chart to show the recording process to which other embodiment of the present invention is applied.

FIG. 14 is the flow chart to show the performance of the aforesaid fourth embodiment, which is realized by replacing the step S8—step S11 shown in FIG. 11 by the flow chart shown in FIG. 14.

At step S31, conveying of recording sheet 11 (in the direction of arrow b) starts and at step S35, the ink sheet 14 is conveyed in the direction of arrow a at speed $V_{PF}/n$ and by the load of torque limiter 85, ink sheet 14 is spread with strain. Thereby the recording sheet 11 is conveyed at the speed $V_{PF}$ for the distance corresponding to the distance l which is from the recording position of the thermal head 13 to the cutting position of the cutter 15 and the ink sheet 14 is conveyed at the speed of $V_{IF}= V_{PF}/n$. Here, n equals to n during recording. When at step S9, recording sheet 11 is cut by the cutter 15, the mode proceeds to step S36 and the recording sheet 11 returns for preset length at speed $V_{PB}$ in the direction. of thermal head 13, the ink sheet 14 is conveyed in the direction of arrow a at speed $V_{IB}$ ($V_{IB}= V_{PB}/n$) (n equals to n during recording), ink sheet 14 is strained and the mode proceeds to step S12. At this time ink sheet 14 is pulled in the direction of arrow a due to the friction between the ink sheet 14 and the recording sheet 11 and together with the action of the load of torque limiter 85, ink sheet 14 is spread with strain in between the ink sheet feed roll 17 and platen roll 12.

In the explanation of this embodiment, it is assumed that n=5 but as shown in FIG. 4A, it is natural that the value of n change according to the change of outer diameter of ink sheet wind-Up roll and thus the speeds of recording sheet and ink sheet naturally change. Therefore the value of the speed may be other than those mentioned in this explanation.

The value n which determines the feed of ink sheet 14 may be changed not only by changing the rotation amount of recording sheet conveying motor 24 and ink sheet conveying motor 25 but also by changing the speed reduction ratio of transmission gears 26, 27 of the driving system of platen roller 12 and the transmission gears 28, 29 of the driving system of wind-up roller 18. When recording sheet conveying motor 24 and ink sheet conveying motor 25 are both stepping motor, the value n may be set by selecting the different minimum step angle for the two motors. In this way, the relative speed of recording sheet 11 and ink sheet 14 may be set at (1+1/n) Vp.

As shown in step S3 and step S4, it is preferred to start driving of ink sheet conveying motor for conveying action earlier than the start of driving of recording sheet conveying motor 24. It is because even when the ink sheet conveying motor 25 is driven, there is a time lag until the conveying of ink sheet 14 actually starts due to the characteristics of the motor or the characteristics of the drive transmission system.

Even when the recording sheet conveying motor 24 may be started earlier, the similar effect is obtained, but if the time span from the start of conveying of recording sheet 11 to the driving of thermal head 13 (recording action stated in step S5),becomes too large, there is possibility that gap is produced between the recorded dots.

Explanation of recording principle (FIG. 10)

FIG. 10 shows the state of image recording when the conveying direction of recording sheet 11 and ink sheet 14 are reversed in this embodiment.

As shown in the drawing, ink sheet 14 sandwiched between the platen roller 12 and thermal head 13 and thermal head 13 is pressed against the platen roller 12 at the specified pressure by the spring 21. Here the recording sheet 11 conveyed in the direction of arrow b by the rotation of platen roller 12 at the speed Vp. On the other hand, ink sheet 14 is conveyed in the direction of arrow a by the rotation of ink sheet conveying motor 25 at the speed $V_I$.

When the heat generating resistor 132 of thermal head 13 is heated by electrification effectuated by power source 105, the part indicated by diagonal line 81 of ink sheet 14 is heated. Here 14*a* represents the base film of ink sheet 14 and 14*b* is the ink layer of ink sheet 14. The ink of the ink layer 81 melts by heating due to heating of heat generating resistor 132 as the result of electrification and the part indicated by 82 is transferred to recording sheet 11. Such part 82 of the ink layer roughly corresponds to 1/n of the ink layer.

It is necessary that at such transcription time, shearing force is produced against the ink at the border 83 of the ink layer 14*b* and thereby only the part of the ink layer indicated by 82 is transferred on to the recording sheet 11. However such shearing force varies according to the temperature of ink layer and it tends to be smaller as the temperature of ink layer becomes higher. When heating time of ink sheet 14 is shortened, shearing force within the ink layer becomes larger and therefore when the relative speed of ink sheet 14 over the recording sheet 11 is larger, it is possible to peel off the ink layer from the ink sheet 14 with the higher certainly.

Since according to this embodiment, heating time of thermal head of facsimile equipment is short being about 0.6 ms, by reversing the direction of conveying of ink sheet 14 and the direction of conveying of recording sheet 11 (face to face direction), the relative speed of ink sheet 14 and recording sheet 11 may be increased.

Figure 15:
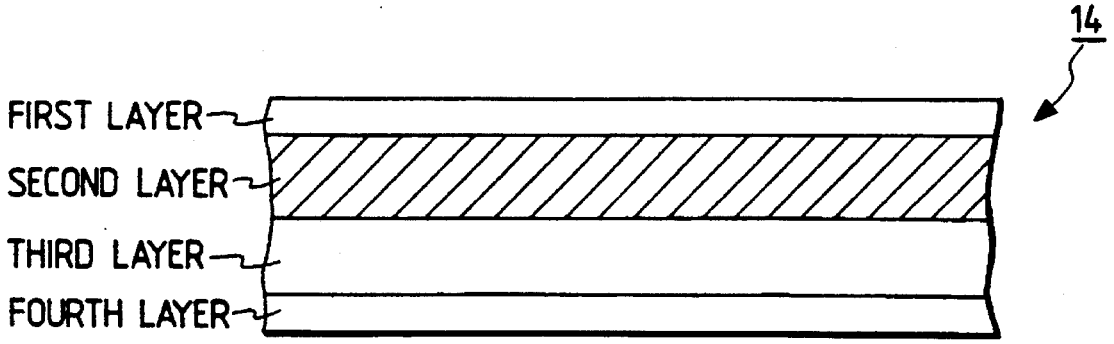
FIG. 15 is a sectional view of the ink sheet used in the embodiment of the present invention.

Explanation of ink sheet (FIG. 15)

FIG. 15 is the sectional view of ink sheet 14 used for multi-print. Here the explanation shall be made on the ink sheet made of four layers.

The second layer is the base film which constitutes the support of the ink sheet 14. In the case of multiprint, since thermal energy is applied repeatedly on the same spot, it is more profitable to use aromatic polyamide film of electric condense sheet which have high heat insulating property but the conventional polyester film will also do. The thickness of the film is preferred to be thin because of the role played by the film, that is, to be the medium to produce the print of the better quality but because of the requirement of strength, the thickness of 3–8 μm is preferred.

The third layer is an ink layer where the ink for the amount sufficient for n times of transfer recording is coated. The ink is mainly composed of such components as EVA or other resins used for adhesive, carbon black for coloring, nigrosine dye, carnauva wax or paraffin wax for binding material, etc. so that the same spot may be used repeatedly for n times. Amount of coating is preferably 4–8 g/m$^2$ but it may be chosen according to the need as the response and darkness of print vary according to the amount of coating.

The fourth layer is the part not printed. It is the top coat layer which is provided to prevent the ink of the third layer transfers to the recording sheet by pressure and it is composed of transparent wax, etc. Consequently the layer which is transferred by pressure is only the transparent fourth layer and thus staining of the ground of recording sheet may be prevented. The first layer is a heat-resistant coating layer which protects the second layer i.e., the base film from the heat of thermal head 13. This is advantageous in the case of multi-print system wherein thermal energy for n lines may be applied on the same spot (when black information continues) but whether to use it or not may be chosen according to the need. It is effective in the case of base film of relatively low heat resistance such as polyester film.

The composition of the ink sheet is not limited to those mentioned above but it may be an ink sheet that is composed of, for example, a base layer and the porous ink holding layer provided at one side of the base layer or may be such sheet as having heat resistant ink layer with micro-porous net structure on the base film and containing ink therein.

The base film may be the film made of polyamide. triacetyl cellulose, nylon, polyvinyl chloride or polypropylene etc. or paper. Heat resistant coating which is not necessarily required may be made of silicone resin, epoxy resin, melamine resin, etc.

The ink coated on the ink sheet 14 is not limited to the hot-melt ink but hot-sublimating ink will also do. The ink sheet coated with such hot-sublimation ink may be so constructed that a coloring material containing spacer granules made of guanamine resin and fluororesin and dyestuff is provided on the substrate film made of, for example, polyethylene telephthalate, polystylene naphthalate or aromatic polyamide.

Heating method is not limited to aforesaid thermal head system to use thermal head but it may be, for example, electrification transfer system or laser transfer system.

In the present embodiment, explanation was made on the case where the conveying direction of recording sheet 11 and that of ink sheet 14 during recording are in reverse with each other but it is not limited to such case but the present invention may be applied to the case where they are conveyed in the same direction.

The recording medium is not limited to the recording sheet but those made of the material which enables transfer of ink, for example, cloth, plastic sheet etc. will also do. The method of setting of ink sheet is not limited to the method to use roll shown in the embodiment but it may be for example an ink sheet cassette wherein the ink sheet is housed in a box which may be mounted on and off the main body of the recording equipment and the box as a whole is mounted on and off the main body of the recording equipment.

In the foregoing embodiments, explanation was made on full line systems but the present inventin is not limited thereto but it may be applied to the so-called serial type thermal transfer recording system.

In the aforesaid embodiments, explanation was made on the cases where the thermal transfer recording apparatus is facsimile but the thermal transfer recording apparatus of the present invention is not limited thereto but it may of course be the systems such as, for example, word processor, typewriter or copying machine.

In the present embodiment, the back feed of recording sheet 11 is exercised when the sheet is cut by the cutter 15 but it is not limited to such case but it may be exercised in the cases, for example, where recording sheet 11 is exchanged, the front end of the recording sheet 11 is conveyed to the cutter position or the front end of the recording sheet 11 is back fed to the image recording position of thermal head 13.

As explained above, according to the present embodiment, such effect is obtained that staining of the surface of recording sheet or creasing or sagging of the ink sheet are prevented by stopping the conveyance of recording sheet or by conveying it at the speed slower than the conveying speed of recording sheet by straining the ink sheet at the time of front feed, while at the time of back feed of recording sheet, by conveying the ink sheet at the speed slower than the conveying speed of the recording sheet.

As explained above, according to this embodiment, such effect is obtained that when recording medium is returned to the direction opposite to the recording direction and the friction force between the ink sheet and recording medium becomes larger than the present level, ink sheet is conveyed in the same direction with that of recording sheet and thus sagging etc. of the ink sheet is prevented.

As detailed above, according to the present invention, sagging etc. of the ink sheet can be eliminated are prevented.

We claim:

1. A thermal transfer recording apparatus for recording on a recording medium by transferring an ink of an ink sheet having said ink on a support member thereof onto said recording medium, said apparatus comprising:

a thermal head for effecting transferring of said ink of said ink sheet at a recording area to record on said recording medium;

winding means for winding said ink sheet, said winding means being operably associated with a driving motor for conveying said ink sheet in a first direction at said recording area;

load means for applying a load to said ink sheet in a second direction opposed to said first direction;

a conveying mechanism for conveying said recording medium in said second direction and reracking said recording medium in said first direction;

a cutter for cutting said recording medium, said cutter being disposed at a position downstream of said recording area with respect to said second direction; and control means for controlling said driving motor and said conveying mechanism (a) to convey said ink sheet in said first direction and a recorded portion of said recording medium in said second direction downstream of the position of said cutter, said recording medium being conveyed faster relative to said ink sheet than during a recording operation, and (b) to retract said recording medium at a retracting speed from the position of said cutter to said recording area, said ink sheet being moved at a speed less than said retracting speed in said first direction against said load by friction between said ink sheet and said recording medium.

2. An apparatus according to claim 1, wherein a conveying amount of said ink sheet when recording is a fraction of a conveying amount of said recording medium.

3. An apparatus according to claim 2, wherein said thermal head has a recording area of a full width in a recording direction and said ink sheet has a recording area of a full width to be recorded in the recording direction.

4. An apparatus according to claim 1, wherein a conveying speed of said ink sheet when recording is less than a conveying speed of said recording medium.

5. An apparatus according to claim 1, wherein said load means comprises a torque limiter.

6. An apparatus according to claim 1, wherein while said recording medium is being retracted after cutting, a phase excitation signal of said driving motor is fixed so that said driving motor exerts a holding torque on said ink sheet, stopping movement of said ink sheet.

7. An apparatus according to claim 1, wherein said apparatus is a facsimile apparatus.

8. An apparatus according to claim 1, wherein said ink sheet is wound by said winding means after said recording medium is retracted and before a next recording is performed so as to remove a slackness in said ink sheet.

9. A thermal transfer recording method for recording on a recording medium by transferring an ink of an ink sheet having said ink on a support member thereof onto said recording medium, said method comprising the steps:

providing a thermal recording head;

providing a driving motor for conveying said ink sheet;

winding said ink sheet in operable association with said driving motor to convey said ink sheet in a first direction at a recording area;

conveying said recording medium in a second direction opposed to said first direction;

recording on said recording medium by using said recording head to act on said ink sheet at said recording area;

conveying said ink sheet in said first direction and a portion of said recording medium recorded in said recording step in said second direction downstream of a cutting position, said cutting position being downstream of said recording area with respect to said second direction, said recording medium being conveyed faster relative to said ink sheet than during a recording operation;

cutting said recording medium at said cutting position;

applying a load to said ink sheet in said second direction; and retracting said recording medium at a retracting speed from said cutting position to said recording area after said cutting step, said ink sheet being moved at a speed less than said retracting steed in said first direction against said load by friction between said ink sheet and said recording medium.

10. A method according to claim 9, wherein a conveying amount of said ink sheet when recording is a fraction of a conveying amount of said recording medium.

11. A method according to claim 10, wherein said thermal head has a recording area of a full width in a recording direction and said ink sheet has a recording area of a full width to be recorded in the recording direction.

12. A method according to claim 9, wherein when conveying said ink sheet when recording said ink sheet is conveyed with a speed that is less than a conveying speed of said recording medium.

13. A method according to claim 9, wherein said step of applying said load is performed by means comprising a torque limiter.

14. An method according to claim 9, further comprising the step of, while said recording medium is being retracted after cutting, fixing a phase excitation signal of said driving motor so that said driving motor exerts a holding torque on said ink sheet, stopping movement of said ink sheet.

15. A method according to claim 9, wherein said method is used in a facsimile apparatus.

16. A method according to claim 9, wherein after said retracting step and before a next recording, said ink sheet is wound to remove a slackness in said ink sheet.

* * * * *

UNITED STATES PATENT AND TRADEMARK OFFICE

CERTIFICATE OF CORRECTION

PATENT NO. : 5,481,291

DATED : January 2, 1996

INVENTOR(S) : YASUSHI ISHIDA ET AL.

It is certified that error appears in the above-identified patent and that said Letters Patent is hereby corrected as shown below:

COLUMN 1

Line 23, "meltably" should read --meltable--.

COLUMN 3

Line 20, "own" should read --same--.
Line 37, "addiron" should read --addition--.

COLUMN 4

Line 5, "113" should read --13--.
Line 28, "detect" should read --detects--.
Line 60, "arrows b" should read --arrow b--.

UNITED STATES PATENT AND TRADEMARK OFFICE

CERTIFICATE OF CORRECTION

PATENT NO. : 5,481,291

DATED : January 2, 1996

INVENTOR(S) : YASUSHI ISHIDA ET AL.

It is certified that error appears in the above-identified patent and that said Letters Patent is hereby corrected as shown below:

COLUMN 5

Line 20, "and—indicates" should read --and "—" indicates--.
Line 25, "$V_{PI}$=Vp-$V_I$=(130 l/n)$V_P$," should read --$V_{PI}$=$V_P$-$V_I$=(1+1/n)$V_P$,--.
Line 40, "$V_I$-5.2(m m/S)." should read --$V_I$≅-5.2(mm/S).--.
Line 51, "standstill" should read --stationary--.

COLUMN 6

Line 20, "alternatively" should read --alternatively be--.

COLUMN 7

Line 26, "FIG. 8," should read --In FIG. 8,--.
Line 44, "exceeds torque" should read --exceeds the maximum load which can be transferred by torque--.
Line 60, "standstill" should read --stationary--.
Line 65, "move" should read --movement--.

UNITED STATES PATENT AND TRADEMARK OFFICE

CERTIFICATE OF CORRECTION

PATENT NO. : 5,481,291

DATED : January 2, 1996

INVENTOR(S) : YASUSHI ISHIDA ET AL.

It is certified that error appears in the above-identified patent and that said Letters Patent is hereby corrected as shown below:

COLUMN 8

Line 60, "embodiment" should read --embodiments--.

COLUMN 9

Line 21, "[mm/$s_I$]" should read --[mm/s]--.
Line 25, "[mm/S]." should read --[mm/S]).
Line 33, "$V_P$=n$V_I$" should read --$V_P$=-n$V_I$--.
Line 57, "step 4." should read --step S4.--.

COLUMN 10

Line 6, "10" should be deleted.
Line 19, "projects" should read --project--.
Line 21, "sheet," should read --sheet--.
Line 46, "sheet-11" should read --sheet 11--.
Line 64, "are" should read --is--.

COLUMN 11

Line 42, "wind-Up" should read --wind-up--.
Line 53, "motor," should read --motors,--.

UNITED STATES PATENT AND TRADEMARK OFFICE

CERTIFICATE OF CORRECTION

PATENT NO. : 5,481,291

DATED : January 2, 1996

INVENTOR(S) : YASUSHI ISHIDA ET AL.

It is certified that error appears in the above-identified patent and that said Letters Patent is hereby corrected as shown below:

COLUMN 12

Line 1, "S5),becomes" should read --S5) becomes--.
Line 10, "conveyed" should read --is conveyed--.
Line 33, "certainly." should read --certainty.--.
Line 59, "carnauva" should read --carnauba--.

COLUMN 13

Line 26, "telephthalate, polystylene" should read --terephthalate, polystyrene--.
Line 48, "inventin" should read ---invention--.

COLUMN 14

Line 14, "are" should read --or--.
Line 31, "reracking" should read --retracting--.

COLUMN 15

Line 8, "steps:" should read --steps of:--.

UNITED STATES PATENT AND TRADEMARK OFFICE

CERTIFICATE OF CORRECTION

PATENT NO. : 5,481,291

DATED : January 2, 1996

INVENTOR(S) : YASUSHI ISHIDA ET AL.

It is certified that error appears in the above-identified patent and that said Letters Patent is hereby corrected as shown below:

COLUMN 16

Line 1, "steed" should read --speed--.

Signed and Sealed this

Sixth Day of August, 1996

Bruce Lehman

*Attest:*

BRUCE LEHMAN

*Attesting Officer*

*Commissioner of Patents and Trademarks*